US005725367A

United States Patent [19]

Joshi et al.

[11] Patent Number: 5,725,367

[45] Date of Patent: *Mar. 10, 1998

[54] METHOD AND APPARATUS FOR DISPERSING FUEL AND OXIDANT FROM A BURNER

[75] Inventors: Mahendra L. Joshi, Altamonte Springs; Lee Broadway, Eustis; Patrick J. Mohr, Mims, all of Fla.

[73] Assignee: Combustion Tec, Inc., Apopka, Fla.

[ * ] Notice: The term of this patent shall not extend beyond the expiration date of Pat. No. 5,545,031.

[21] Appl. No.: 580,126

[22] Filed: Dec. 28, 1995

Related U.S. Application Data

[63] Continuation-in-part of Ser. No. 366,621, Dec. 30, 1994, Pat. No. 5,545,031.

[51] Int. Cl.[6] ..... F23C 5/00

[52] U.S. Cl. ..... 431/8; 239/424; 431/189; 431/187

[58] Field of Search ..... 431/181, 185, 431/189, 187, 186; 239/424

[56] References Cited

U.S. PATENT DOCUMENTS

| | | | |
|---|---|---|---|
| 1,566,177 | 12/1925 | Whitaker . | |
| 2,804,917 | 9/1957 | Smith et al. | 431/186 |
| 2,813,754 | 11/1957 | Zielinski . | |
| 3,100,461 | 8/1963 | Werner | 431/186 |
| 4,504,213 | 3/1985 | Markus . | |
| 4,909,727 | 3/1990 | Khinkis . | |
| 4,911,637 | 3/1990 | Moore et al. . | |
| 5,076,779 | 12/1991 | Kobayashi . | |
| 5,135,387 | 8/1992 | Martin et al. . | |
| 5,169,304 | 12/1992 | Flament et al. . | |
| 5,199,866 | 4/1993 | Joshi et al. . | |
| 5,217,363 | 6/1993 | Brais et al. . | |
| 5,217,366 | 6/1993 | Laurenceau et al. . | |
| 5,256,058 | 10/1993 | Slavejkov et al. . | |
| 5,292,244 | 3/1994 | Xiong . | |
| 5,299,929 | 4/1994 | Yap . | |
| 5,346,390 | 9/1994 | Slavejkov et al. . | |
| 5,360,171 | 11/1994 | Yap . | |
| 5,545,031 | 8/1996 | Joshi et al. | 431/187 |

FOREIGN PATENT DOCUMENTS

| | | | |
|---|---|---|---|
| 4719485 | 3/1986 | Australia . | |
| 0513414 | 11/1992 | European Pat. Off. . | |
| 162413 | 7/1948 | Germany | 431/186 |
| 780961 | 8/1957 | United Kingdom | 431/186 |

*Primary Examiner*—Carl D. Price

*Attorney, Agent, or Firm*—Speckman, Pauley & Fejer

[57] ABSTRACT

A method and apparatus for injecting fuel and oxidant into a combustion burner. At a fuel exit plane of a fuel discharge nozzle, fuel is discharged in a generally planar fuel layer which has an upper boundary and a lower boundary. At an oxidant exit plane, oxidant is preferably discharged in both a top layer along the upper boundary of the fuel layer and a bottom layer along the lower boundary of the fuel layer. In a downstream flow direction, the fuel and oxidant preferably converge in a generally vertical plane and diverge in a generally horizontal plane. The discharged fuel and oxidant form a fishtail or fan-shaped flame configuration. The fuel exit plane can be moved upstream or downstream with respect to the oxidant exit plane to vary the flame characteristics and the flame shape. A refractory manifold can be used to further enhance the fishtail or fan-shaped flame configuration.

11 Claims, 7 Drawing Sheets

METHOD AND APPARATUS FOR DISPERSING FUEL AND OXIDANT FROM A BURNER

This is a continuation-in-part patent application of U.S. patent application having Ser. No. 08/366,621, filed 30 Dec. 1994, now U.S. Pat. No. 5,545,031.

BACKGROUND OF THE INVENTION

1. Field of the Invention

This invention relates to a method and apparatus for discharging fuel and oxidant from a nozzle in a fashion that forms a fishtail or fan-shaped flame which produces uniform heat distribution and relatively high radiative heat transmission. The exit plane of the fuel nozzle can be longitudinally moved with respect to the exit plane of the oxidant nozzle so that the fuel exit plane is either upstream, at, or downstream with respect to the oxidant exit plane, in order to adjust the flame characteristics.

2. Description of Prior Art

Combustion technology involving 100% oxygen-fuel is relatively new in glass melting applications. Many conventional burners use a cylindrical burner geometry wherein fuel and oxidant are discharged from a cylindrical nozzle, such as a cylindrical refractory burner block. Such cylindrical discharge nozzles produce a flame profile that diverges at an included angle of 20° to 25°, in a generally conical shape. Conventional burners that produce generally conical flames create undesirable hot-spots in a furnace. The hot-spots result in furnace refractory damage, particularly to furnace crowns and sidewalls which are opposite the flame. Such conventional burners also result in increased batch volatilization and uncontrolled emissions of nitrogen oxides, sulfur oxides and process particles.

To overcome some of the problems associated with such designs, conventional burners have incorporated low momentum flow wherein relatively lower oxygen and fuel velocities are used to create relatively lower momentum flames. Such lower velocities and thus lower momentums result in longer flames and increased load coverage. However, a flame lofting problem occurs at such relatively low velocities and thus causes undesirable effects.

Some conventional burners employ a staggered firing arrangement in an attempt to improve effective load coverage, particularly with the use of conical expansion of individual flames. However, the staggered firing arrangement often creates undesirable cold regions in pocket areas between adjacent burners. To overcome such problem, other conventional burners have attempted to increase the number of flames by using more burners. However, increasing the number of burners significantly increases installation and operation costs.

U.S. Pat. No. 5,217,363 teaches an air-cooled oxygen gas burner having a body which forms three concentric metal tubes supported in a cylindrical housing and positioned about a conical bore in a refractory sidewall of a furnace. The three concentric tubes can be adjusted with respect to each other to define a nozzle with annular openings of variable size for varying the shape of a flame produced by a mixture of fuel, oxygen and air. The air is fed through an outer chamber, for cooling the concentric tube assembly and the furnace refractory positioned about the burner nozzle.

U.S. Pat. Nos. 5,256,058 and 5,346,390 disclose a method and apparatus for generating an oxy-fuel flame. The oxy-fuel flame is produced in a concentric orifice burner and thus results in a generally cylindrical flame. A fuel-rich flame is shielded within a fuel-lean or oxygen-rich flame. The flame shielding is controlled in order to achieve a two-phase turbulent diffusion flame in a precombustor, in order to prevent aspiration of corrosive species and also to reduce nitrogen oxides formation.

U.S. Pat. No. 5,076,779 discloses a combustion burner operating with segregated combustion zones. Separate oxidant mixing zones and fuel reaction zones are established in a combustion zone, in order to dilute oxidant and also to combust fuel under conditions which reduce nitrogen oxides formation.

It is apparent that there is a need for an oxy-fuel burner which can be used in high-temperature furnaces, such as glass melting furnaces, wherein the relative position of the fuel exit plane can be adjusted with respect to the position of the oxidant exit plane in order to vary the flame characteristics and thereby accomplish, for example, uniform heat distribution, reduced undesirable emissions, such as nitrogen oxides and sulfur oxides, and a highly radiative and luminous flame.

SUMMARY OF THE INVENTION

It is one object of this invention to provide a burner nozzle which produces a fishtail or fan-shaped flame resulting in improved load coverage and a highly radiative flame, particularly for efficient transmission of visible radiation in a wavelength range of approximately 500 nanometers to approximately 2000 nanometers, for example.

It is another object of this invention to provide a method and apparatus for longitudinally adjusting a position of the fuel exit plane with respect to the oxidant exit plane and thereby altering the flame characteristics.

It is another object of this invention to provide a burner nozzle that produces a fishtail or fan-shaped flame wherein the fuel and oxidant are uniformly distributed in a generally horizontal direction, particularly when discharged from the nozzle.

It is another object of this invention to provide a horizontally diverging burner block that allows the fuel and oxidant discharged from the nozzle to be further directed outward in a horizontally diverging direction, in order to enhance development of the fishtail or fan-shaped flame configuration.

The above and other objects of this invention are accomplished with a method and apparatus for injecting fuel and oxidant into a combustion burner, wherein the fuel is discharged from a nozzle in a generally planar fuel layer, forming a fishtail or fan-shaped fuel layer having a generally planar upper boundary and a generally planar lower boundary. Oxidant is discharged from the nozzle so that a generally planar oxidant layer is formed at least along the upper boundary of the fuel layer and preferably also along the lower boundary of the fuel layer.

In one preferred embodiment according to this invention, a fuel manifold is positioned within an oxidant manifold. Both the fuel manifold and the oxidant manifold preferably have a rectangular cross section at an exit plane, for producing the fishtail or fan-shaped flame configuration. With a relatively simple mechanical mechanism, the fuel manifold can be adjustably and lockingly moved in a generally longitudinal direction with respect to the oxidant manifold. Thus, the fuel exit plane can be moved to a position upstream, equal to, or downstream with respect to the oxidant exit plane to thereby adjust the flame characteristics. Such relative movement can be accomplished manually or with a suitable control system that can receive input signals from various sensors detecting flame and/or furnace operating parameters.

In one preferred embodiment according to this invention, both the fuel manifold and the oxidant manifold have a generally square-shaped cross section at an upstream location, which along a downstream flow path converges in a generally vertical direction and diverges in a generally horizontal direction to form the generally rectangular cross section at the exit plane. The combined converging and diverging effect, as a result of the geometry of the fuel manifold and the oxidant manifold, produces a net transfer of momentum of the fluid from a generally vertical plane to a generally horizontal plane. Thus, the fuel and oxidant are discharged from the nozzle in a relatively wide and uniformly distributed fashion. The relatively wide distribution produces the fishtail or fan-shaped flame configuration.

It is apparent that the dimensions of the discharge nozzle or discharge nozzles can be varied to achieve certain desired fuel and oxidant velocities. Such dimensions are designed in order to achieve desired combustion gas velocities and flame development in a downstream flow direction.

According to another preferred embodiment of this invention, the fuel and oxidant are discharged from the nozzle into a burner block, such as a burner block constructed of refractory, which enhances development of an oxy-fuel flame into a fishtail or fan-shaped configuration. Downstream of the oxidant nozzle exit plane, the generally planar fuel layer is sandwiched between generally planar top and bottom layers of oxidant. The discharge nozzle preferably produces a fuel-rich central or core layer and an oxygen-rich top and bottom layer. Peak flame temperatures remain relatively low in the horizontally diverging manifold section of the burner block, due to the limited amount of oxygen and fuel combustion taking place within the burner block. The oxygen-rich top and bottom layers flow over the refractory or burner block surfaces and thus result in convective cooling of the refractory or burner block.

As the fuel and oxidant mixture flows through the burner block, partial combustion takes place and thus raises the pressure and temperature of the partially combusted fuel and oxidant mixture. The partial combustion causes relatively hot gases to expand in all directions. Because the manifold section of the burner block preferably maintains a constant distance between the upper and lower flow surfaces but diverges between the opposing side flow surfaces, in the downstream flow direction, the burner block or manifold section geometry further assists the partially combusted fuel and air mixture to diverge in the generally horizontal planar direction. Such enhanced diverging flow results in a relatively wider or more pronounced fishtail or fan-shaped flame configuration.

According to the method and apparatus of this invention, the velocity of the oxidant and fuel discharged from the manifold section of the burner block is relatively lower which thus enables relatively fuel-rich combustion to occur in the horizontally central core region of the overall fishtail or fan-shaped flame configuration. In the horizontally central core region, the fuel undergoes a cracking reaction because of the relatively slow reaction between the fuel and the oxidant, and because of the relatively large surface area of the nozzle. The fuel cracking produces a relatively large amount of soot particles, aromatics and hydrogen. The formed soot particles react with oxygen to produce a highly luminous and relatively long flame. Such highly luminous and relatively long flame can be at least two times more radiative, in visible wavelength spectrum, than conventional oxy-fuel burners having cylindrical block geometry. The fishtail or fan-shaped flame configuration produced by the method and apparatus according to this invention has a flame envelope that is significantly larger than the envelope produced by conventional cylindrical block burners. Thus, the method and apparatus according to this invention produces a relatively high radiative heat-flux to the load, which results in higher throughput and increased fuel efficiency.

BRIEF DESCRIPTION OF THE DRAWINGS

The above-mentioned and other features of this invention will become more apparent, and the invention itself will be best understood by reference to the following description of specific embodiments of the invention taken in conjunction with the accompanying drawings, in which.

DESCRIPTION OF PREFERRED EMBODIMENTS

Figure 1:
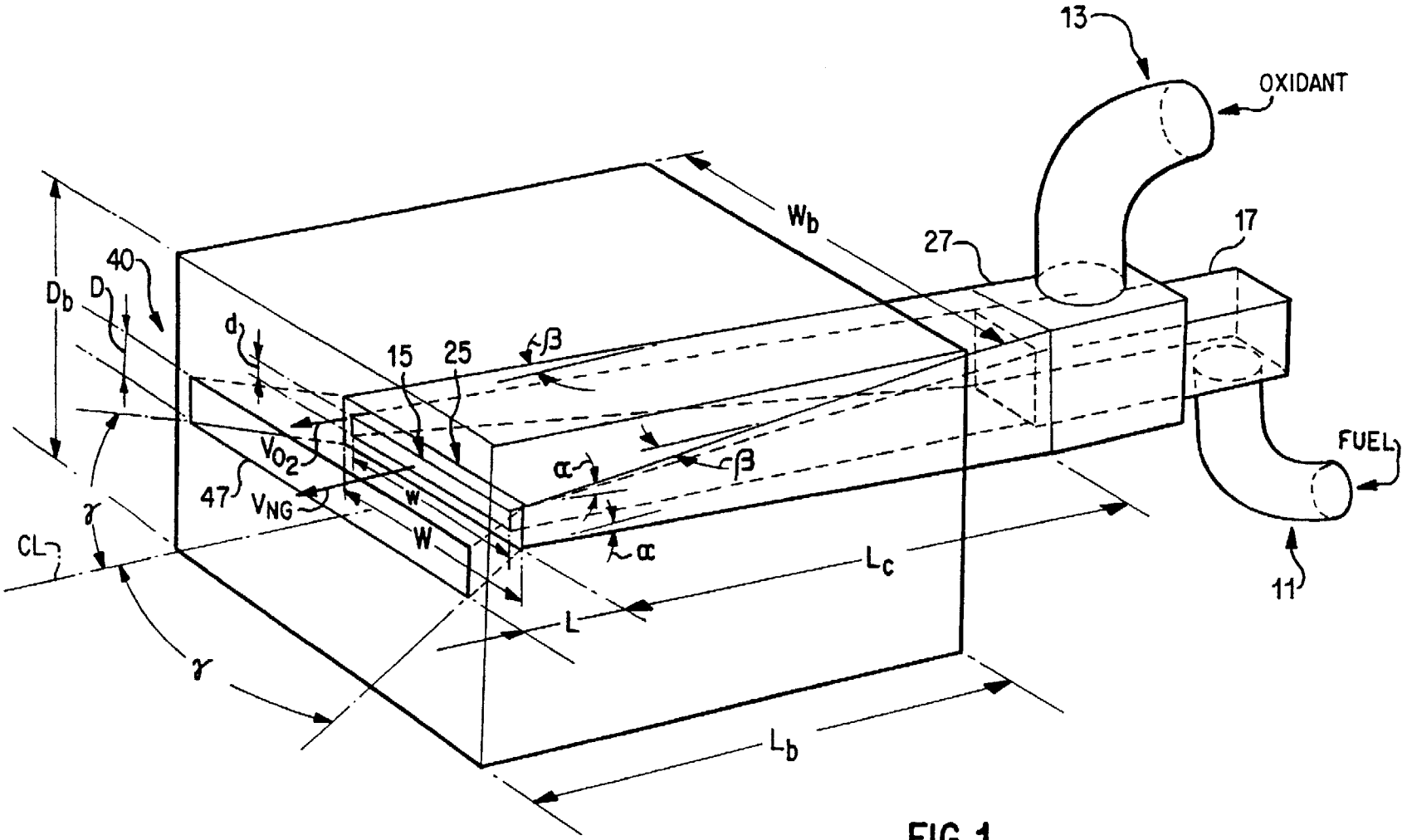
FIG. 1 is a perspective schematic view of an apparatus that produces a fishtail or fan-shaped flame configuration, according to one preferred embodiment of this invention.

Referring to FIGS. 1–5, fuel is introduced into fuel manifold 17 through fuel inlet means 11, and oxidant is introduced into oxidant manifold 27 through oxidant inlet means 13. It is apparent that fuel inlet means 11 and oxidant inlet means 13 may comprise a fuel inlet nozzle and oxidant inlet nozzle, as shown in FIG. 1, or may comprise any other suitable inlet means for introducing fuel and oxidant into corresponding manifolds, as known to those skilled in the art.

As used throughout this specification and in the claims, the term fuel is intended to interchangeably relate to any suitable gaseous fuel, vaporized liquid fuel, liquefied gas, or any other fuel suitable for combustion purposes. One preferred fuel is natural gas. As used throughout this specification and in the claims, the term oxidant is intended to interchangeably relate to oxygen, air, oxygen-enriched air, or any other suitable oxidant known to those skilled in the art. One preferred oxidant used in connection with the method according to this invention is pure or 100% oxygen. The combination of pure or 100% oxygen and natural gas is often used in high-temperature furnaces, such as glass melting furnaces.

According to one preferred embodiment of this invention, an apparatus for injecting the fuel and the oxidant into a combustion burner comprises fuel discharge nozzle 15 and oxidant discharge nozzle 25. Fuel means are used to discharge the fuel from a fuel exit plane generally defined by fuel discharge nozzle 15, preferably in a generally planar fuel layer which has a generally planar upper boundary and a generally planar lower boundary. First oxidant means are used to discharge a first portion of the oxidant from an oxidant exit plane generally defined by oxidant discharge nozzle 25, preferably in a generally planar first oxidant layer, preferably along the upper boundary of the fuel layer. Second oxidant means are used to discharge a second or remaining portion of the oxidant from the oxidant exit plane at oxidant discharge nozzle 25, also in a generally planar second oxidant layer, preferably along the lower boundary of the fuel layer.

As used throughout this specification and in the claims, the phrase generally planar layer is intended to relate to a fluidic layer of gas or vaporized fuel, for example, having a defined layer thickness and an overall generally planar shape. Such generally planar layer may also be referred to as a blanket of gas or vaporized liquid. The generally planar layer of fuel and oxidant are formed within fuel discharge nozzle 15 and oxidant discharge nozzle 25, respectively. Upstream of the generally vertical exit planes, one at fuel discharge nozzle 15 and another at oxidant discharge nozzle 25, the fuel and oxidant are correspondingly formed into separate generally planar layers. Downstream of the exit planes, the generally planar layers of fuel and oxidant begin to commingle at their common boundaries and continue to mix as the flow proceeds in the downstream direction.

At the generally vertical exit planes established at the outlet of fuel discharge nozzle 15 and at the outlet of oxidant discharge nozzle 25, the generally planar fuel layer is sandwiched between the first oxidant layer and the second oxidant layer. As the oxidant and fuel flow in the downstream direction, the oxidant begins to mix with the fuel to create a fuel-rich phase layer of a fuel/oxidant mixture which is sandwiched between two oxygen-rich phase layers of the fuel/oxidant mixture. Because of the fuel-rich central region and the oxygen-rich top and bottom regions, the peak flame temperatures of combustion occurring shortly downstream of fuel discharge nozzle 15 and oxidant discharge nozzle 25 are extremely low. Such relatively low peak flame temperatures result in reduced undesirable emissions. With the oxygen-rich top and bottom layers of fuel/oxidant mixture flow, convective cooling of refractory manifold 47 occurs.

In one preferred embodiment according to this invention, the fuel means used to discharge the fuel from fuel discharge nozzle 15 comprise fuel manifold 17 having a generally rectangular cross section at a downstream portion of fuel manifold 17. As best shown in FIG. 1, according to one preferred embodiment of this invention, fuel manifold 17 has a generally square cross section at an upstream portion. As fuel manifold 17 extends into the downstream portion, the cross section becomes much more rectangular, with a long side of the rectangle preferably positioned in a generally horizontal direction. It is apparent that the upstream portion can have any suitably shaped cross section, including a circular cross section, as long as the upstream section transitions into a generally rectangular cross section at the downstream portion.

Figure 2:
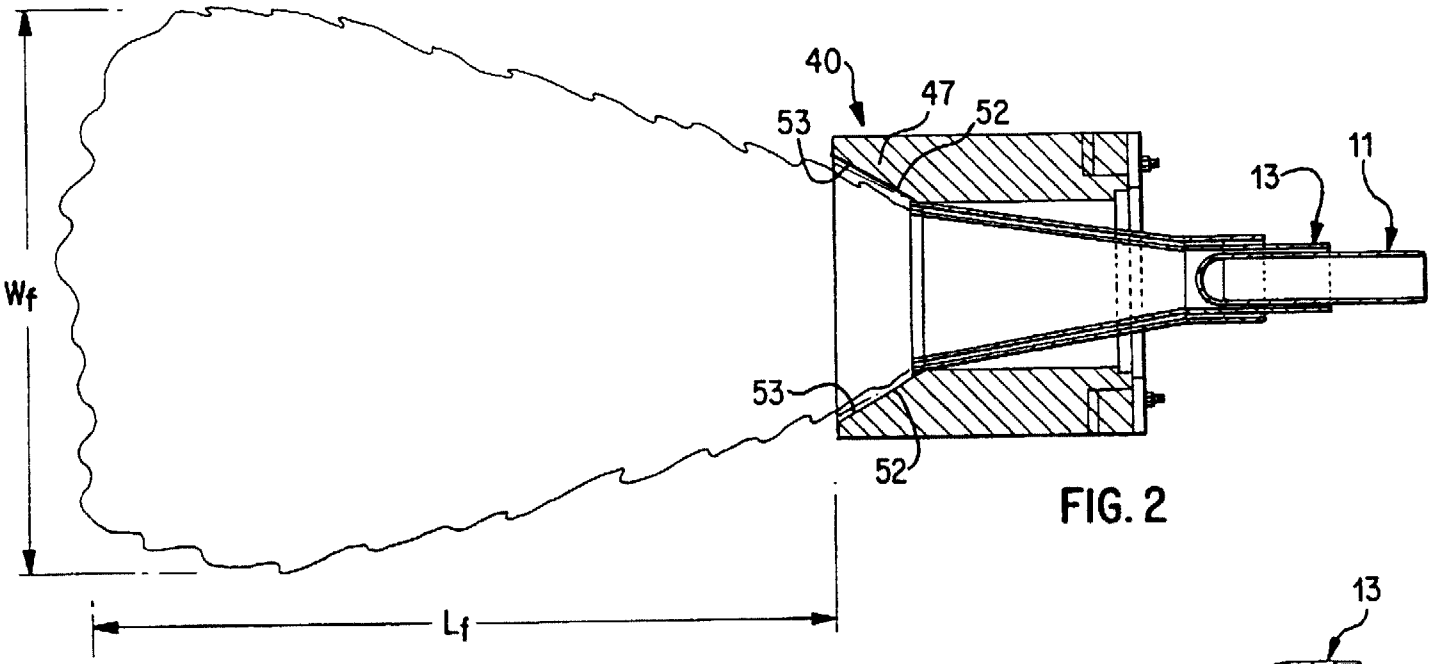
FIG. 2 is a cross-sectional top view of the apparatus shown in FIG. 1, with a fishtail or fan-shaped flame being discharged from an exit plane of a burner block.
Figure 3:
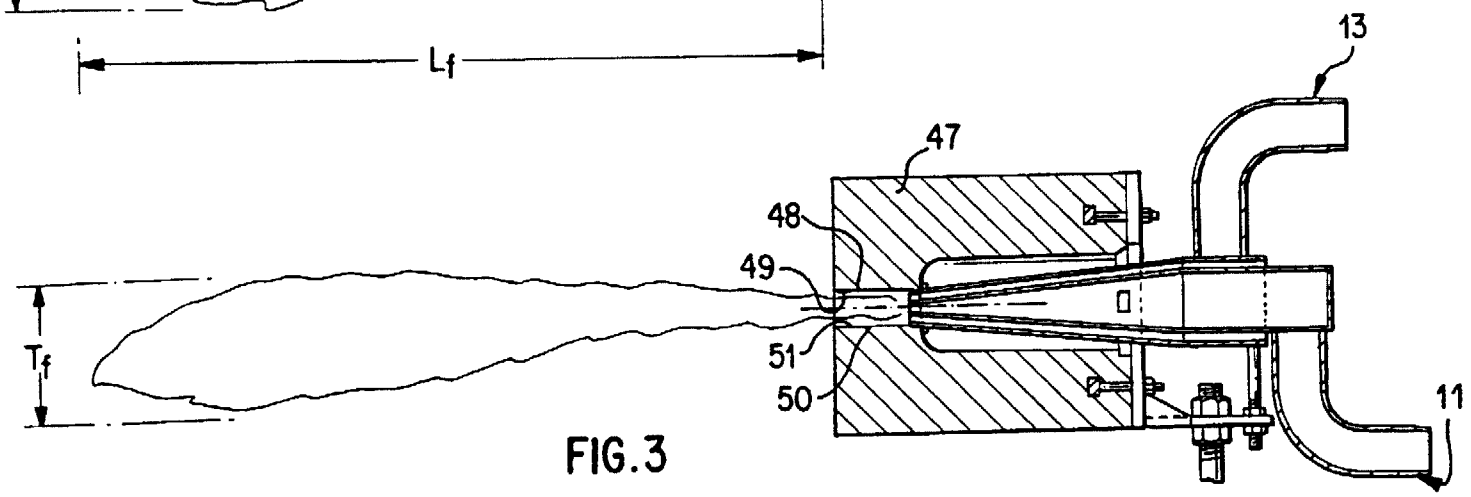
FIG. 3 is a cross-sectional side view of the fishtail or fan-shaped apparatus shown in FIG. 1, with the fishtail or fan-shaped flame being discharged, as shown in FIG. 2.
Figure 4:
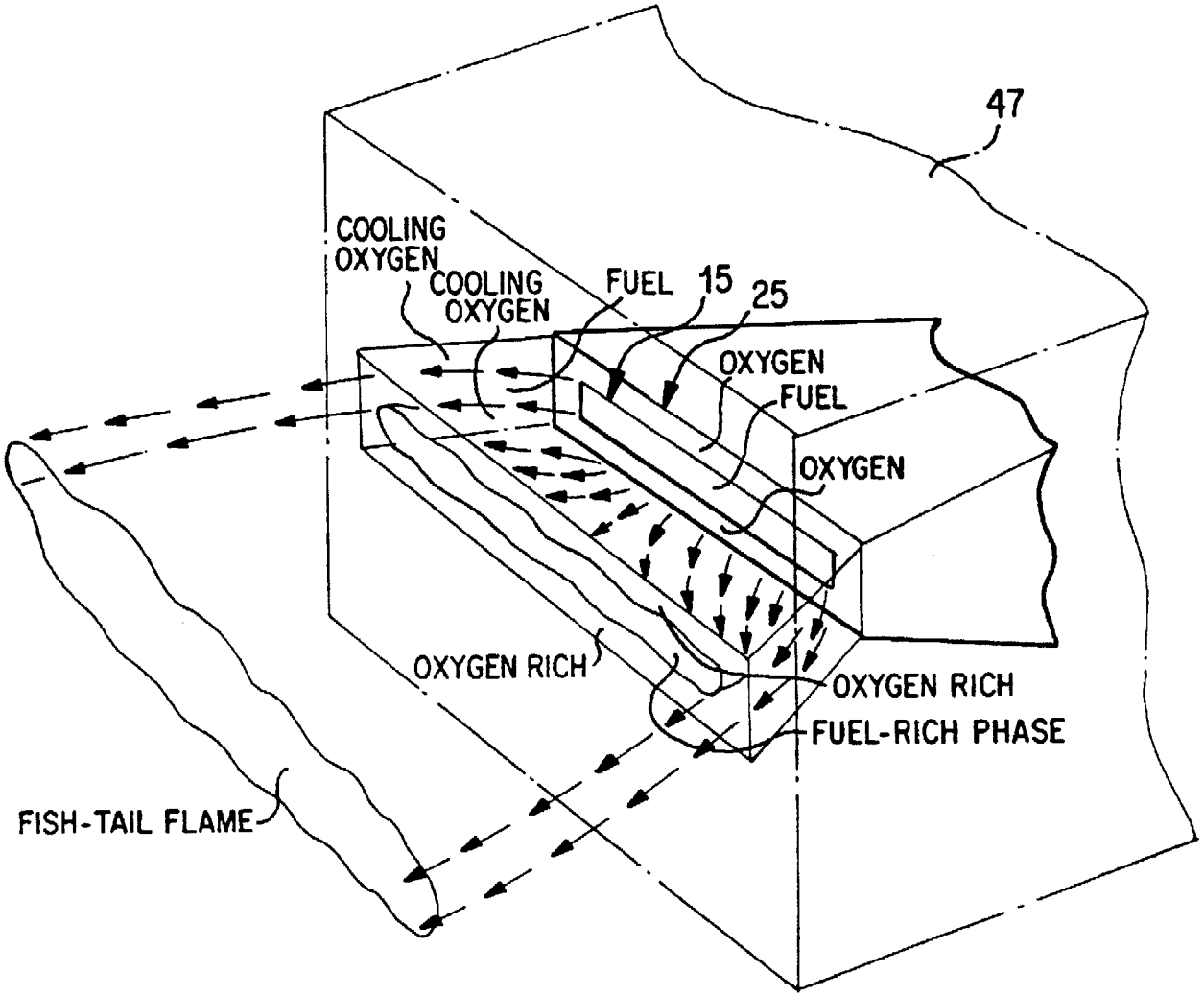
FIG. 4 is a perspective schematic view of the different layers of fuel and oxidant being discharged from a nozzle and the burner block, according to one preferred embodiment of this invention.

As used throughout this specification and in the claims, vertical and horizontal directions are preferably referred to with respect to gravitational forces. However, the terms vertical and horizontal are intended to specify directions with respect to each other and are not necessarily limited to directions with respect to the gravitational forces. As shown in FIGS. 1–3, the fishtail or fan-shaped flame configuration has the flat portion of the flame generally oriented in the horizontal direction, which is preferred. However, it is apparent that such flat portion can be oriented at any other suitable angle, which would accomplish the same result of producing a fishtail or fan-shaped flame with a fuel-rich layer sandwiched between two oxidant-rich layers. With the flat portion oriented at another suitable angle, the generally horizontal direction would not be with respect to gravitational forces.

As clearly shown in FIGS. 1–5, the fuel means further comprise the actual wall surfaces, upper flow surface 19 of upper wall 18 and lower flow surface 21 of lower wall 20, diverging in the downstream flow direction. The opposing side flow surfaces 23 of opposing side walls 22 each preferably converge in the downstream flow direction. The actual wall surfaces of opposing side flow surfaces 23 preferably meet or intersect with upper flow surface 19 and lower flow surface 21. As shown in FIGS. 1–5, upper wall 18 and lower wall 20 converge with respect to each other, and opposing side walls 22 diverge with respect to each other, in the downstream direction.

The overall shape of oxidant manifold 27 is preferably but not necessarily similar to that of fuel manifold 17. According to one preferred embodiment of this invention, the actual wall surfaces, upper flow surface 29 of upper wall 28 and lower flow surface 31 of lower wall 30, also diverge in the downstream flow direction. The actual wall surfaces of opposing side flow surfaces 33 of opposing side walls 32 preferably converge in the downstream flow direction. Opposing side flow surfaces 33 preferably meet or intersect with upper flow surface 29 and lower flow surface 31. As shown in FIGS. 1–5, upper wall 28 and lower wall 30 converge with respect to each other and opposing side walls 32 diverge with respect to each other, in the downstream direction.

In one preferred embodiment according to this invention, fuel manifold 17 is positioned within oxidant manifold 27, as clearly shown in FIG. 1. A major portion of fuel manifold 17 is shown in dashed or hidden lines in FIG. 1, since fuel manifold 17 is positioned within oxidant manifold 27.

Figure 5:
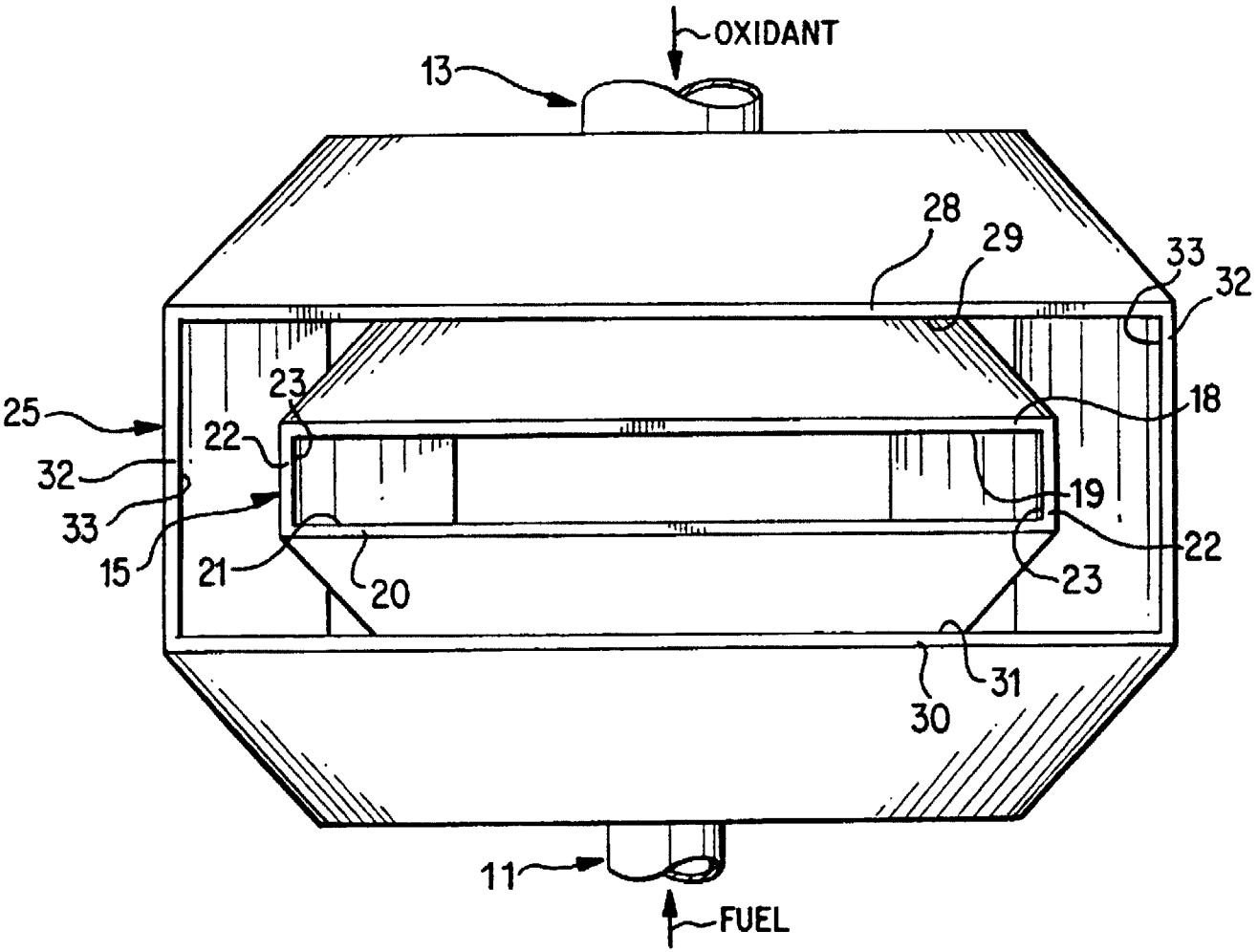
FIG. 5 is a front view of a discharge nozzle at an exit plane, looking in an upstream flow direction, according to one preferred embodiment of this invention.
Figure 6:
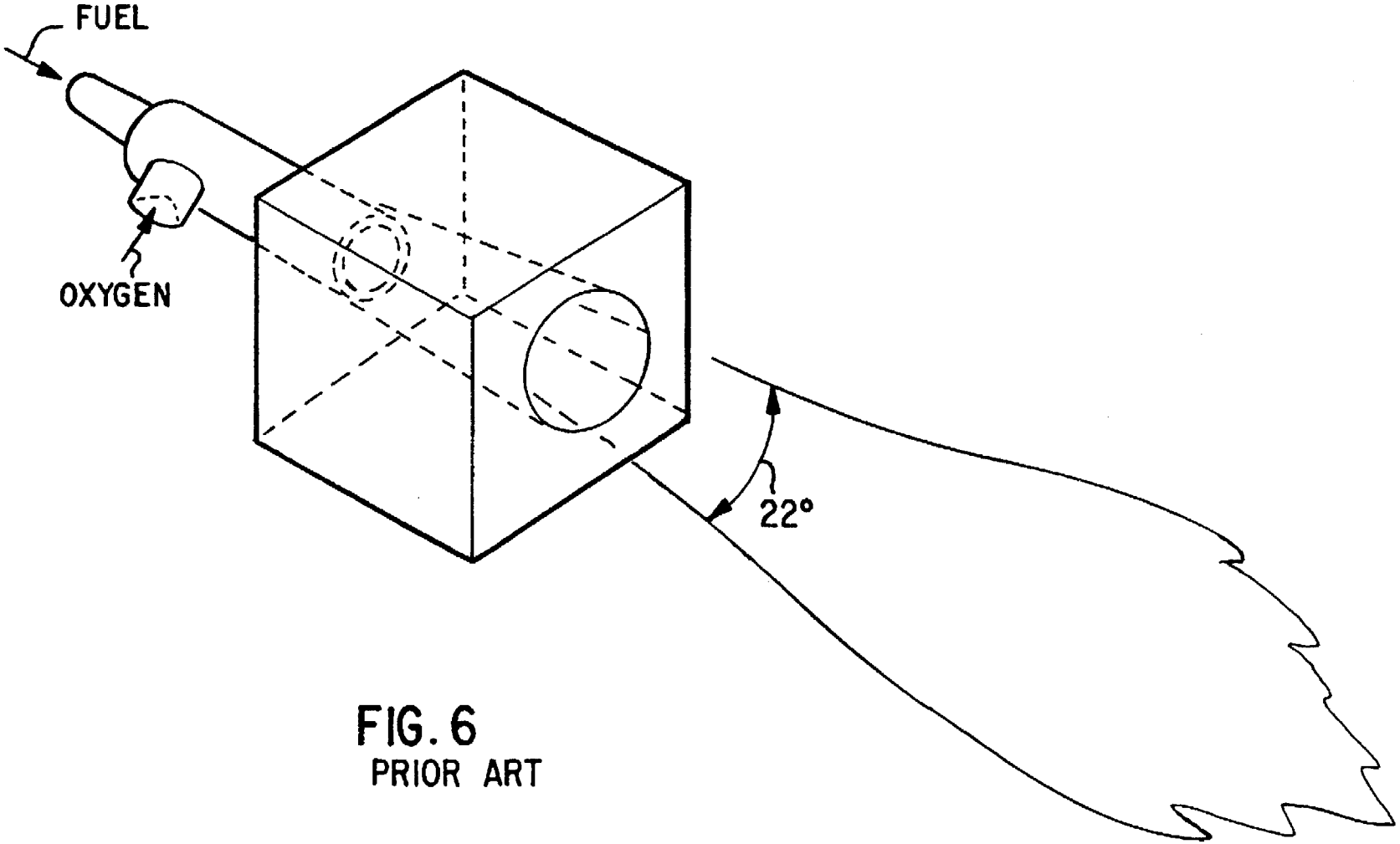
FIG. 6 PRIOR ART
FIG. 6 is a perspective schematic view of a conventional cylindrical burner which produces a generally conical flame.

As clearly shown in FIG. 5, an oxidant flow channel is defined between upper wall 18 and upper wall 28, between lower wall 20 and lower wall 30, and preferably but not necessarily also between opposing side walls 22 and respective opposing side walls 32. In one preferred embodiment according to this invention, as clearly shown in FIGS. 1, 4 and 5, the oxidant flowing between corresponding side flow surfaces 23 and 33 also sandwiches the fuel layer, in a side-to-side manner.

The converging effect that both the oxidant and the fuel experience in the downstream flow direction promotes uniform distribution of the fuel and oxidant, particularly at the generally vertical exit planes located at the outlets of fuel discharge nozzle 15 and oxidant discharge nozzle 25.

As shown in FIG. 1, convergence angle α is the angle at which opposing side flow surfaces 23 converge, and preferably but not necessarily the angle at which opposing side flow surfaces 33 converge. Divergence angle β is the angle at which upper flow surface 19 and lower flow surface 21 diverge, and preferably but not necessarily the angle at which upper flow surface 29 and lower flow surface 31 diverge. Divergence angle 7 is the included angle at which the flame diverges, as measured from the centerline direction of refractory manifold 47.

As the fuel and oxidant are discharged from fuel discharge nozzle 15 and oxidant discharge nozzle 25, respectively, the generally planar layers of flow are preferably directed into divergent means 40 for enhancing the horizontal divergence of fuel from fuel discharge nozzle 15 and oxidant from oxidant discharge nozzle 25, in the downstream flow direction. In one preferred embodiment according to this invention, divergent means 40 comprise refractory manifold 47 having a generally rectangular cross section. Upper flow surface 49 of upper wall 48 and lower flow surface 51 of lower wall 50 preferably diverge in the downstream flow direction. The distance between upper flow surface 49 and lower flow surface 51 is preferably but not necessarily maintained constant. By maintaining such distance constant, because of expansion forces associated with partial combustion within refractory manifold 47, the fuel and oxidant diverge in the horizontal direction and thus further enhance the fishtail or fan-shaped flame configuration. The approximate configuration of the fishtail or fan-shaped flame is clearly shown in FIG. 2.

FIG. 1 shows various dimensions which may be critical to the method and apparatus of this invention, depending upon the particular use of the burner. The method and apparatus of this invention were experimentally tested and preferred ranges of such dimensions are discussed below, as well as the effect upon the burner performance by varying such dimensions. It should be noted that the following ranges of dimensions, angles and velocities are those which are preferred based upon experiments conducted with the method and apparatus of this invention. However, it should be noted that further experimentation could reveal other suitable dimensions, angles, ratios and velocities outside of the preferred ranges. The dimensions, angles, ratios and velocities discussed below are examples and are specifically intended to not limit the scope of this invention.

Convergence angle α, as shown in FIG. 1, is measured within a generally vertical plane. According to one preferred embodiment of this invention, convergence angle α is approximately 3° to approximately 8°. Convergence angle α represents the angle at which side flow surfaces 23 and side flow surfaces 33 converge with respect to the horizontal. A properly selected convergence angle α allows the respective flow surface to adequately squeeze or pinch the fuel or oxidant streamlines in the flow axis, so that the fuel or oxidant flow converges at a somewhat steady rate without undue turbulence. The transfer of fluidic momentum of the fuel or oxidant, from the vertical plane to the horizontal plane, is a function of convergence angle α, as well as divergence angle β. A proper balance between the design of convergence angle α and divergence angle β is required for adequately converging and simultaneously diverging the flow streamlines of both the fuel and the oxidant.

According to one preferred embodiment of this invention, divergence angle β is preferably in a range of approximately 6° to approximately 12°. Divergence angle β is measured in a generally horizontal plane and dictates the degree to which upper flow surface 19, lower flow surface 21, upper flow surface 29 and lower flow surface 31 diverge in the generally horizontal direction. Because of divergence angle β, the fluidic fuel stream and the fluidic oxidant stream each expand while each such fluid is simultaneously forced to converge within their respective manifold, due to convergence angle α. When divergence angle β is too large, empty fluidic pockets can form near sidewalls 22 and sidewalls 32 of fluid discharge nozzle 15 and oxidant discharge nozzle 25, respectively. When divergence angle β is too small, relatively heavy fluid distribution can occur closer to the center of fuel discharge nozzle 15 or oxidant discharge nozzle 25. A proper combination of both convergence angle α and divergence angle β will result in uniformly distributed fuel and oxidant streams across the exit cross section of fuel discharge nozzle 15 and oxidant discharge nozzle 25, which will ultimately result in uniform flame development and uniform cooling of refractory manifold 47.

According to one preferred embodiment of this invention, the ratio $L_c/W$, the convergence length $L_c$ to the divergence width W of oxidant discharge nozzle 25, is preferably in a range of approximately 1 to approximately 3. The ratio $L_c/W$ is heavily based upon the values of convergence angle α and divergence angle β. The ratio $L_c/W$ is also based upon the firing capacity of the burner. For relatively higher firing rates the ratio $L_c/W$ is a larger number, and for relatively lower firing rates the ratio $L_c/W$ is a smaller number.

According to one preferred embodiment of this invention, the ratio W/D, the width W to the depth D of oxidant discharge nozzle 25, is preferably in a range of approximately 3 to approximately 6. A relatively higher ratio W/D tends to spread the oxidant in the horizontal plane, whereas a relatively lower ratio W/D tends to increase the thickness of the oxidant layer in the generally vertical plane, at given values for the oxidant velocity, the firing rate, convergence angle α and divergence angle β. The oxidant velocity, depending upon the burner firing rate, is preferably in a range from approximately 5 to approximately 100 ft/sec.

According to one preferred embodiment of this invention, the ratio w/d, which is a ratio of the width w to the depth d of fuel discharge nozzle 15, is preferably in a range of approximately 15 to approximately 25. A relatively higher ratio w/d tends to spread the fuel in the horizontal plane, whereas a relatively lower ratio w/d tends to increase the thickness of the fuel layer, when measured in the vertical plane. The ratio w/d is selected depending upon the desired fuel velocity discharged from fuel discharge nozzle 15, at given values for the firing rate, convergence angle α and divergence angle β. When the fuel is natural gas, a preferred range of fuel velocities, depending upon the burner firing rate, is from approximately 5 to approximately 150 ft/sec.

According to another preferred embodiment of this invention, flame divergence angle γ, which is measured in the generally horizontal plane, from the centerline axis of refractory manifold 47 as shown in FIG. 1, is preferably in a range from approximately 10° to approximately 40°. Flame divergence angle γ depends upon the design of refractory manifold 47. The divergence of the flame discharged from refractory manifold 47 is influenced by flame divergence angle γ. A relatively lower flame divergence angle γ intensifies the combustion process and a relatively higher flame divergence angle γ reduces the overall cooling effect of the oxidant on the flow surfaces of refractory manifold 47. A properly selected flame divergence angle γ will result in optimum divergence of the flame due to combustion induced expansion of relatively hot combustion gases, for greater load coverage. A properly selected flame divergence angle γ will also assist in stabilizing the combustion process within refractory manifold 47, or another suitable burner block, and thus will optimize the cooling effect upon refractory manifold 47. A properly selected flame divergence angle γ will also result in refractory manifold 47 being completely filled with relatively hot combustion gases, which also prevents inspiration of furnace gases or particulates into refractory manifold 47, or another suitable burner block.

According to another preferred embodiment of this invention, the ratio L/D, which is a ratio of the flow length L to the flow depth D of refractory manifold 47, is preferably in a range of approximately 1.5 to approximately 2.5. The ratio L/D influences the flame luminosity, as well as the cooling effect caused by the oxidant flow over upper flow surface 49 of upper wall 48, lower flow surface 51 of lower wall 50 and side flow surfaces 53 of sidewalls 52. A relatively higher ratio L/D tends to accelerate the fuel/oxidant combustion process and thus reduce the thickness of the oxidant layers which sandwich the fuel layer. Depending upon the particular design of the burner, an oxidant layer thickness of approximately ⅜" to approximately ¾" is preferred for adequate cooling of refractory manifold 47. A properly selected L/D ratio will result in good flame luminosity and partial fuel cracking within the central fuel layer. As the L/D ratio is increased, such as beyond approximately 2.5, the combustion process can become more intense within refractory manifold 47, the generation of soot species can be significantly reduced, and the flame luminosity can also be reduced. By lowering the L/D ratio, such as lower than approximately 1.5, the residence time for the hot gases to expand and shape the flame becomes too short.

The velocities of the fuel and oxidant at the nozzle exit planes become important design parameters when the combustion burner operates with pure or 100% oxygen and fuel. Through experimentation, a prototype of a method and apparatus according to this invention produced a turndown ratio of 10:1, for a firing range of 0.5 to 5 MM BTU/hr. Such turndown ratio was effective for a fuel velocity in a range of approximately 8 to approximately 80 ft/sec, and an oxidant velocity in the range of approximately 4 to approximately 40 ft/sec, which resulted in a suitably shaped fishtail configuration and a highly luminous flame. Relatively higher velocities can be achieved by using smaller nozzle exit areas and would likely result in reduced flame luminosity. With the firing rate in the range of approximately 0.5 to approximately 5 MM BTU/hr, the flame length $L_f$ varied between approximately 4 ft to approximately 8 ft, the flame width $W_f$ varied between approximately 3 to approximately 5 ft, and the flame thickness $T_f$ varied between approximately 3 to approximately 6 in, and had the overall approximate shape as generally indicated in FIGS. 2 and 3. According to another preferred embodiment of this invention, the length $L_b$ of the burner block, as shown in FIG. 1, was chosen as approximately 10 to approximately 18 in. The width $W_b$ of the burner block was chosen to be in a range of approximately 12 to approximately 24 in. The depth $D_b$ of the burner block was chosen to be in a range of approximately 12 to approximately 16 in. The experiments were conducted with pare or 100% oxygen as the oxidant and natural gas as the fuel. It is apparent that other firing rates and values for the burner design parameters can be selected, which would significantly vary the angles, ratios, velocities and dimensions as previously discussed. The values of such parameters as discussed above are intended to represent an example of values for such parameters that have been proven based upon conducted experiments. It is apparent that further experimentation could reveal values for such parameters which fall outside of the ranges, as discussed above, without significantly affecting the performance of the method and apparatus according to this invention.

Figure 7:
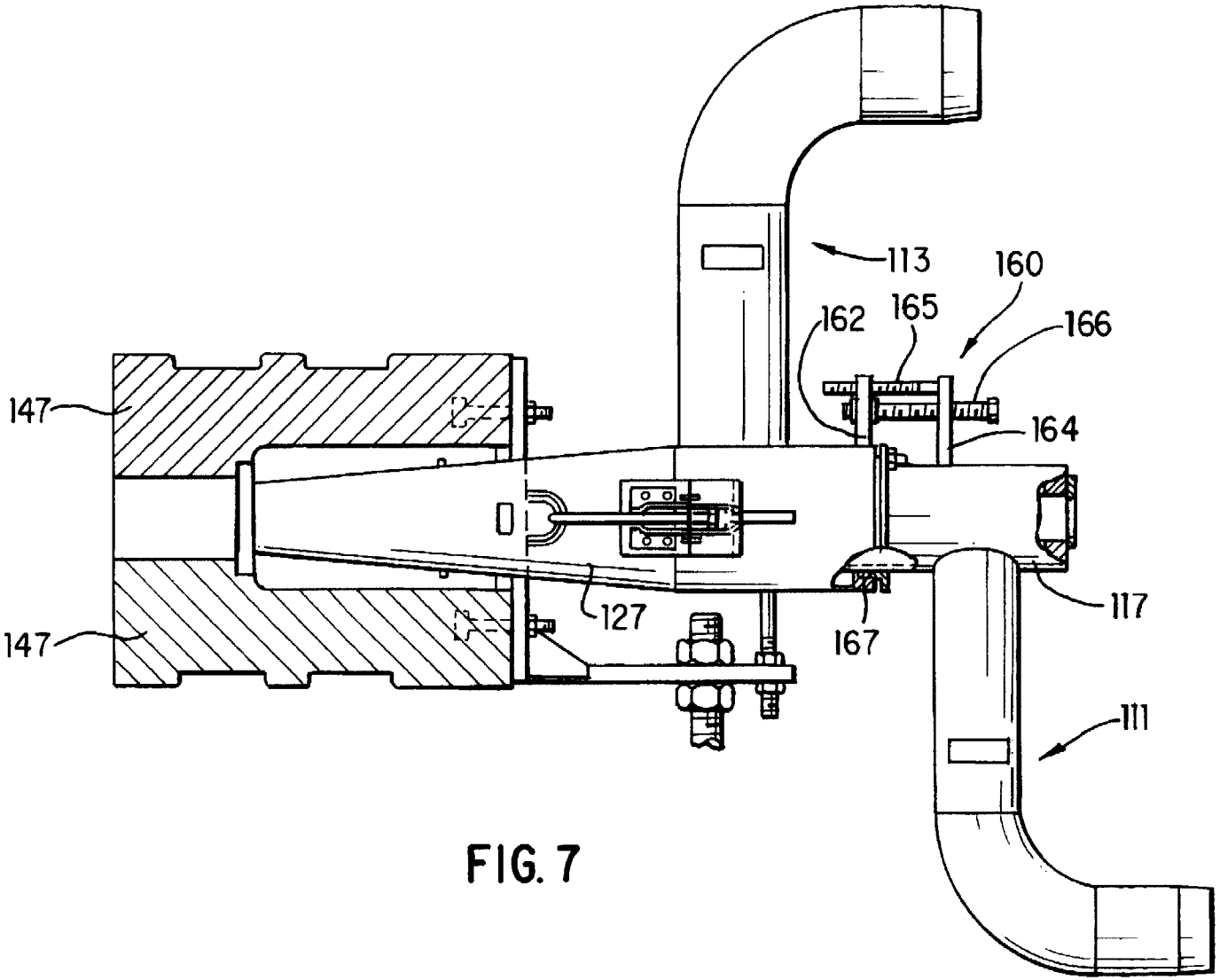
FIG. 7 is a partial cross-sectional side view of a fuel manifold adjustably mounted within an oxidant manifold, wherein the oxidant manifold is mounted within a burner block, according to one preferred embodiment of this invention.
Figure 8:
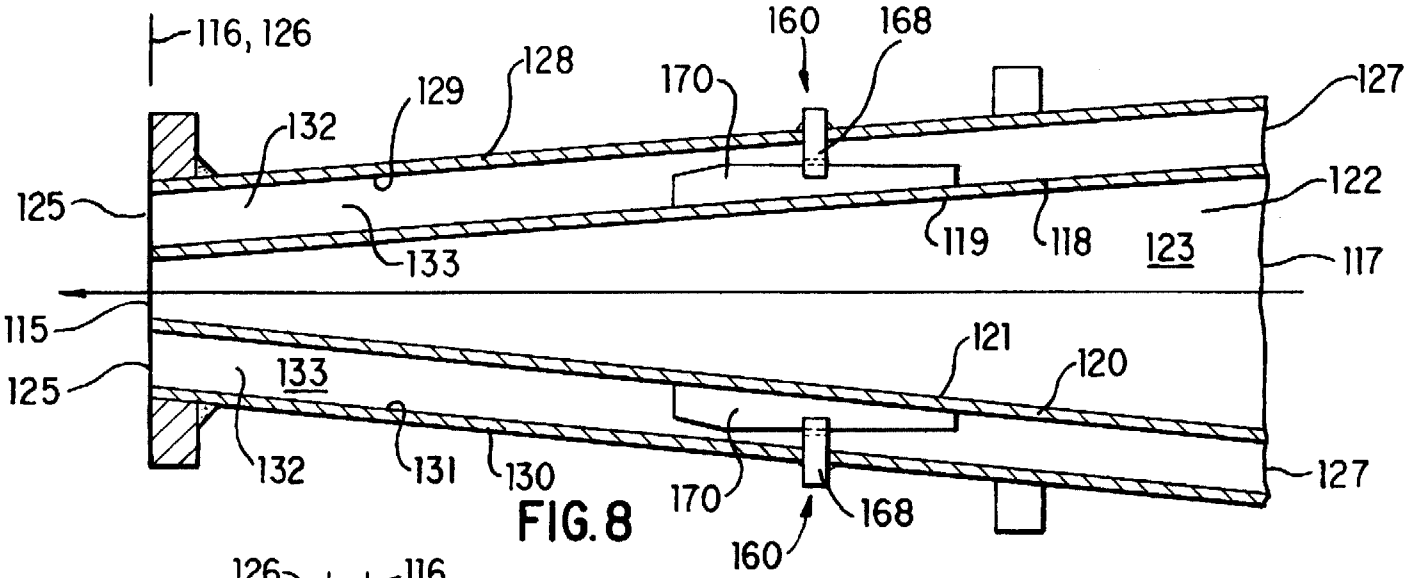
FIG. 8 is a partial cross-sectional partial side view of the fuel manifold adjustably mounted within the oxidant manifold, as shown in FIG. 7.
Figure 10:
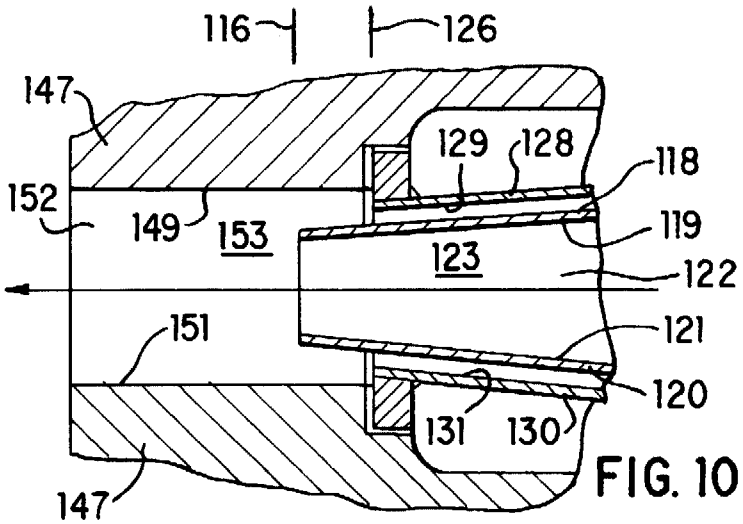
FIG. 10 is a cross-sectional partial side view of the fuel manifold and the oxidant manifold as shown in FIG. 9, but with the fuel exit plane positioned downstream with respect to the oxidant exit plane.
Figure 9:
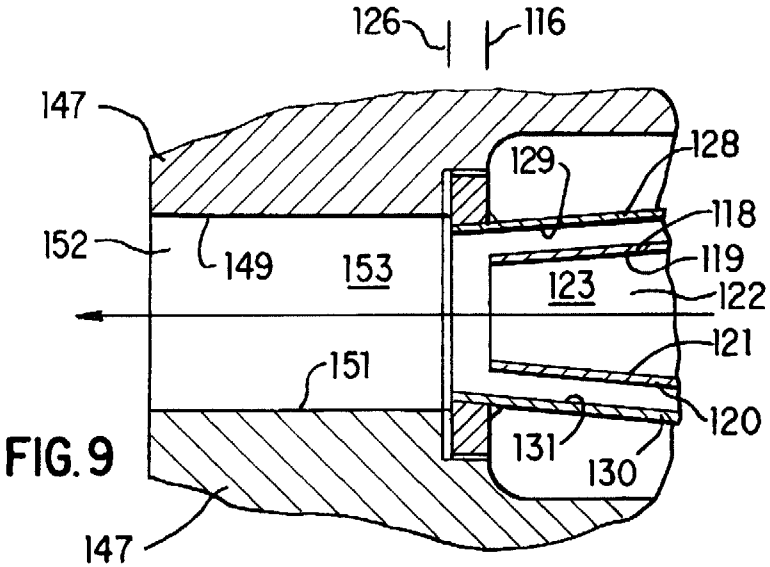
FIG. 9 is a cross-sectional partial side view of a fuel manifold having a fuel exit plane positioned upstream with respect to an oxidant exit plane of an oxidant manifold, according to one preferred embodiment of this invention.

According to another preferred embodiment of this invention, as shown in FIGS. 7–10, fuel manifold 117 can be adjustably moved in a longitudinal direction in order to adjustably vary the position of fuel exit plane 116 with respect to oxidant exit plane 126. As shown in FIG. 9, fuel manifold 117 is positioned with respect to oxidant manifold 127 such that fuel exit plane 116 is in an upstream position with respect to oxidant exit plane 126. The position of fuel manifold 117 with respect to oxidant manifold 127 can be adjusted in the longitudinal direction so that fuel exit plane 116 is downstream with respect to oxidant exit plane 126, as shown in FIG. 10. The arrow in each of FIGS. 9 and 10 represents both the general longitudinal direction and the downstream direction of fluid flow through fuel manifold 117 and oxidant manifold 127.

As shown in FIG. 7, oxidant manifold 127 is secured with respect to refractory manifold 147. A forward portion of fuel manifold 117 is mounted within oxidant manifold 127. O-ring 167 is used to hermetically seal the connection between fuel manifold 117 and oxidant manifold 127. It is apparent that a gasket or other suitable sealing device known to those skilled in the art can be used in addition to or in lieu of O-ring 167.

FIG. 8 shows a partial cross-sectional partial side view of the forward portion of fuel manifold 117, as mounted within oxidant manifold 127. Although oxidant manifold 127 preferably remains secured with respect to refractory manifold 147 and fuel manifold 117 preferably moves in a general longitudinal direction, such as along the arrow shown in FIG. 8, it is apparent that other mechanical arrangements can be used to accomplish the same relative movement. For example, the position of fuel manifold 117 can be fixed with respect to refractory manifold 147 and oxidant manifold 127 can be adjustably moved with respect to fuel manifold 117.

As shown in FIG. 7, adjustment means 160 are used to adjustably move and fix fuel manifold 117 with respect to oxidant manifold 127. According to one preferred embodiment of this invention as shown in FIG. 7, adjustment means 160 comprise bracket 162 fixed with respect to oxidant manifold 127 and bracket 164 fixed with respect to fuel manifold 117. Screw 166 is threadedly engaged within corresponding internally threaded holes within bracket 162 and bracket 164. By rotating screw 166 bracket 164 moves with respect to bracket 162 and thus fuel manifold 117 moves with respect to oxidant manifold 127. Sight gauge 165 can be secured to either bracket 162 or bracket 164, for example, to indicate the position of fuel manifold 117 relative to oxidant manifold 127 and thus the position of fuel exit plane 116 relative to oxidant exit plane 126. It is apparent that other suitable mechanical devices known to those skilled in the art can be used to adjustably move and fix the position of fuel manifold 117 with respect to oxidant manifold 127.

As shown in FIG. 8, pin 168 has a slot, identified by dashed lines, into which guideplate 170 slidably engages. Pin 168 acts as a guide for maintaining the longitudinal sliding direction of fuel manifold 117 with respect to oxidant manifold 127. As shown in FIG. 8, pin 168 is fixed in a suitable manner, such as being welded or the like, with respect to oxidant manifold 127. It is apparent that other mechanical devices known to those skilled in the art can be used to guide longitudinal movement of fuel manifold 117 with respect to oxidant manifold 127. It is also apparent that the roles can be reversed by securing pin 168 with respect to fuel manifold 117 and securing guideplate 170 with respect to oxidant manifold 127.

As shown in FIG. 9, fuel exit plane 116 is positioned upstream with respect to oxidant exit plane 126. As shown in FIG. 10, fuel exit plane 116 is positioned downstream with respect to oxidant exit plane 126. The arrows indicate the general direction of fluid flow.

Longitudinal adjustment of fuel manifold 117 with respect to oxidant manifold 127 enables adjustment of the flame characteristics, including the flame shape. By adjusting the flame characteristics and the flame shape, it is possible to optimize load coverage and to produce a highly radiative flame, particularly for oxygen-fuel combustion. Varying the flame shape allows a burner according to this invention to be used in various furnace sizes. For example, the melt area, load surface area or overall furnace length-to-width dimensions, relative to flame coverage, can be optimized by adjusting the flame shape.

By adjusting the position of fuel exit plane 116 relative to oxidant exit plane 126, the peak flame temperature can be variably positioned along the longitudinal axis of the flame. Adjusting the flame shape can also result in different heat-release patterns and overall heat-transfer rates that the flame offers to its surroundings. A properly adjusted flame can significantly improve fuel efficiency and furnace overall productivity.

As shown in FIG. 9, fuel exit plane 116 is positioned upstream with respect to oxidant exit plane 126. Although the distance between fuel exit plane 116 and oxidant exit plane 126 can vary as a function of the furnace and/or flame requirements, according to one preferred embodiment of this invention, such distance is about 0.5". As shown in FIG. 10, fuel exit plane 116 is positioned downstream with respect to oxidant exit plane 126. Although such distance can also vary depending upon the flame and/or furnace requirements, according to one preferred embodiment of this invention, such distance can be as much as about 1".

As shown in FIG. 9, with fuel exit plane 116 positioned further upstream with respect to oxidant exit plane 126, fuel is discharged from fuel discharge nozzle 115 also at a position upstream with respect to oxidant exit plane 126, thus resulting in the fuel mixing with the oxidant relatively further upstream within oxidant manifold 127. With such physical arrangement, the combustion process begins relatively early and produces relatively higher fuel-oxidant mixing rates, relatively higher flame gas momentum, relatively higher peak flame temperatures, a relatively shorter and wider flame, and relatively lower flame luminosity.

As shown in FIG. 10, with fuel exit plane 116 positioned downstream with respect to oxidant exit plane 126, the fuel is injected downstream of oxidant discharge nozzle 125 and thus oxidant-fuel mixing occurs relatively later as fuel exit plane 116 is moved further downstream with respect to oxidant exit plane 126. With such physical arrangement, the combustion process is relatively delayed, which results in relatively lower fuel-oxidant mixing rates, relatively lower flame gas momentum, relatively lower peak flame temperatures, a relatively longer and narrower flame, and relatively higher flame luminosity.

The oxidant velocity varies as fuel manifold 117 is moved with respect to oxidant manifold 127, because of the change in cross-sectional area of the oxidant flow path. However, according to one preferred embodiment of this invention, because of the relatively slight angles at which the walls of fuel manifold 117 and oxidant manifold 127 converge and diverge, moving fuel exit plane 116 between extreme upstream and downstream positions results in only a difference of about 10%–15% in oxidant flow velocities. Except for any slight pressure difference at fuel discharge nozzle 115, because the cross-sectional area of the fuel path remains constant the velocity of fuel within fuel manifold 117 remains approximately constant as fuel manifold 117 is moved between extreme upstream and downstream positions.

It is apparent that various components shown in the drawings can be interchanged without departing from the results desired from this invention. It is also apparent that the various elements can be manufactured with any suitable materials that satisfy operating conditions of various furnaces.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A method of dispersing fuel and oxidant from a burner, the method including the steps of:

dispersing the fuel in a downstream direction from an inner nozzle in a generally planar fuel layer, the inner nozzle having upper and lower substantially planar walls in the downstream direction converging with respect to each other; and dispersing the oxidant in the downstream direction from an outer nozzle spaced about said inner nozzle and having upper and lower substantially planar walls in the downstream direction converging with respect to each other and in the downstream direction side walls diverging with respect to each other, and contacting the dispersed oxidant with the dispersed fuel.

2. The method of claim 1 wherein flame characteristics are adjusted by longitudinally moving a fuel exit plane of the inner nozzle with respect to an oxidant exit plane of the outer nozzle.

3. The method of claim 1 wherein the fuel exit plane is moved to a longitudinal position upstream, relative to flow through the burner, with respect to the oxidant exit plane.

4. The method of claim 1 wherein the fuel exit plane is moved to a longitudinal position downstream, relative to flow through the burner, with respect to the oxidant exit plane.

5. The method of claim 1 wherein side walls of the inner nozzle diverge with respect to each other.

6. A burner for dispersing fuel and oxidant into a combustion zone, the burner comprising;

an inner nozzle for dispersing the fuel in a generally planar fuel layer, the inner nozzle having upper and lower substantially planar walls converging with respect to each other and side walls diverging with respect to each other and forming a substantially rectangular outlet;

an outer nozzle spaced about said inner nozzle for dispersing the oxidant and having upper and lower walls converging with respect to each other and side walls diverging with respect to each other and forming a substantially rectangular outlet; and adjustment means for adjustably moving and fixing a longitudinal position of a fuel exit plane of said inner nozzle with respect to an oxidant exit plane of said outer nozzle.

7. The burner of claim 1 wherein said fuel exit plane is moveable to a position upstream, relative to flow through the burner, with respect to said oxidant exit plane.

8. The burner of claim 7 wherein said fuel exit plane is moveable to a position downstream, relative to flow through the burner, with respect to said oxidant exit plane.

9. The burner of claim 8 wherein said adjustment means comprise a first bracket secured with respect to said inner nozzle, a second bracket secured with respect to said outer nozzle, said first bracket having a first internally threaded hole, said second bracket having a second internally threaded hole, and an externally threaded screw mateably engaged within said first internally threaded hole and said second internally threaded hole.

10. The burner of claim 8 wherein said adjustment means comprise a pin having a slot, said pin secured with respect to said outer nozzle, a guideplate secured with respect to said inner nozzle, and said guideplate slidably mounted within said slot.

11. The burner of claim 1 wherein said adjustment means comprise a pin having a slot, said pin secured with respect to said inner nozzle, a guideplate secured with respect to said outer nozzle, and said guideplate slidably mounted within said slot.

* * * * *